United States Patent [19]

Mendelson et al.

[11] Patent Number: 4,909,951

[45] Date of Patent: Mar. 20, 1990

[54] LUBRICATING COMPOSITIONS

[75] Inventors: Leah T. Mendelson, Santa Ana; Richard L. Pilling, Fullerton, both of Calif.

[73] Assignee: Union Oil Company of California

[21] Appl. No.: 314,946

[22] Filed: Feb. 24, 1989

Related U.S. Application Data

[63] Continuation-in-part of Ser. No. 253,139, Oct. 4, 1988, and a continuation-in-part of Ser. No. 260,912, Oct. 21, 1988.

[51] Int. Cl.[4] ..... C10M 135/14

[52] U.S. Cl. ..... 252/17; 252/28; 252/29; 252/39; 252/42.7; 72/42

[58] Field of Search ..... 252/42.7, 35, 17

[56] References Cited

U.S. PATENT DOCUMENTS 4,476,113 10/1984 Young et al. ..... 424/161
4,551,167 11/1985 Young et al. ..... 71/903
4,726,144 2/1988 Young et al. ..... 405/36

OTHER PUBLICATIONS

Mills et al. Journal of The Chemical Society, vol. 1928 (II), pp. 2326–2332 (1928).
O'Donaohue et al. Journal of The Chemical Society, vol. 89 (II), pp. 1812–1818 (1906).
Yeoman, Journal of The Chemical Society, vol. 119, pp. 38–54 (1921).

*Primary Examiner*—William R. Dixon, Jr.
*Assistant Examiner*—Ellen M. McAvoy
*Attorney, Agent, or Firm*—Gregory F. Wirzbicki; Arthur E. Oaks; Michael H. Laird

[57] ABSTRACT

Additives comprising an adduct of a calcium salt of a thiocarbonic acid and calcium hydroxide are useful in lubricants to enhance both the extreme pressure/anti-wear and anti-oxidation capabilities thereof. The lubricants are preferably oils of lubricating viscosity, which may be thickened to a grease-like consistency with one or more oil thickeners and contain from about 0.1 to about 20 weight percent of said adduct.

41 Claims, No Drawings

LUBRICATING COMPOSITIONS

CROSS-REFERENCE TO RELATED APPLICATIONS

This application is a continuation-in-part of co-pending applications Ser. No. 253,139, filed Oct. 4, 1988 pending and Ser. No. 260,912, pending filed Oct. 21, 1988, both of which are herein incorporated by reference in their entireties.

BACKGROUND OF THE INVENTION

1. Field of the Invention

This invention relates to lubricating oil and grease compositions, and more particularly to lubricating compositions having improved anti-wear/extreme pressure and/or anti-oxidant properties.

2. Description of the Prior Art

Anti-wear additives are chemicals which are added to lubricants to prevent destructive metal-to-metal contact in the lubrication of relatively moving surfaces. Plain mineral oils provide good lubrication and protection against excessive wear just as long as a film of oil is maintained between the relatively moving surfaces. This kind of lubrication, termed "hydrodynamic," is governed by the parameters of the lubricant, principally its viscosity. When the pressures or rubbing speeds between the moving surfaces increase to the point where the film of oil can be squeezed or wiped out, metal-to-metal contact begins to occur, often over a significant portion of the lubricated area. This kind of lubrication, termed "boundary lubrication," is governed largely by parameters of the contacting surfaces such as surface finish, metal shear strength and the coefficient of friction between the metals involved. Unless these parameters can be chosen to meet expected pressures and rubbing speeds, destructive metal-to-metal contact will occur. Such destructive contact manifests itself in various ways including scoring, scuffing, ridging, rippling and, in extreme cases, welding, leading to a catastrophic deformation and/or complete destruction of the lubricated components.

Anti-wear additives, which are added to many lubricants to prevent such destructive results from occurring, appear to function by reacting with relatively moving surfaces under boundary lubrication conditions to form an adherent solid lubricant film which has a lower shear strength than that of the metal surfaces. It is thought that this film takes over the task of lubrication when metal-to-metal contact occurs, thus protecting the metal surfaces from damage.

Over the years, the development of satisfactory oil and grease compositions for preventing excessive wear under high pressure, high temperature and/or high speed conditions has received much attention and numerous additives have been proposed for such service. Among these additives are compounds that generally contain lead, sulfur, phosphorus, halogen (principally chlorine), and carboxylate salts, organic phosphates and phosphites. The list also includes chlorinated waxes, sulfurized unsaturated organic compounds, heavy metal sulfides such as lead sulfide and molybdenum disulfide, and antimony thioantimonate. However, many of these materials are expensive and also extremely toxic. There is therefore a need for lubricating additives which are environmentally benign and inexpensive to use. The present invention provides such an additive.

SUMMARY OF THE INVENTION

The present invention is an extreme pressure/antiwear lubricating composition comprised of a major amount of a lubricating oil or grease and a minor amount of an adduct additive comprised of a calcium salt of a thiocarbonic acid and calcium hydroxide, said composition being used to provide improved protection against excessive wear in bearings, gears, automotive engine components and other mechanical structures subjected to heavy rolling or sliding loads and/or to protect the base oil or grease against oxidative degradation.

As used herein, the term "thiocarbonate" shall mean those compounds containing a group of the general formula:

$$(C_aS_b)$$

wherein a is between about 1 and about 4 and b is between about 3 and about 9 and $(C_aS_b)$ is present as the anionic moiety in a salt. The term "adduct" shall refer to a solid double salt of a calcium thiocarbonate, as hereinabove defined, with calcium hydroxide. The term "water-free," when applied to the adduct of the present invention and to the media from which it is precipitated, shall mean that the water content thereof is below the amount which would cause observable decomposition or hydrolysis of a thiocarbonate salt dissolved or suspended therein or which results in in the formation and/or separation of an aqueous solution/suspension of said adduct.

DETAILED DESCRIPTION OF THE INVENTION

The lubricating compositions described herein comprise an oil of lubricating viscosity, which is compounded with an anti-wear effective amount of an adduct of a calcium salt of a thiocarbonic acid and calcium hydroxide and, when a grease, one or more thickeners.

The oils which form the major constituent of the lubricating compositions are the oils of lubricating viscosity, said viscosity being from about 35 to about 200 SUS at 210° F. Typical oils meeting this criterion are naphthenic, paraffinic and aromatic mineral oils derived from petroleum, shale, gasified coal, bitumen, tar sands, etc., and synthetic oils. Suitable petroleum base oils are derived from distillate lubrication oils having an initial boiling point in the range of about 350° F. to about 475° F., and endpoint in the range of about 500° F. to about 1100° F., and a flashpoint not lower than about 110° F.

Synthetic lubricating oils useful herein are those derived from a product of chemical synthesis, i.e., manufactured oils. Typical examples of such materials include polyglycol fluids such as polyalkylene glycols, polyorganophosphates, polyphenyl esters, synthetic hydrocarbons such as polyalphaolefins, various polyesters and diseters of organic acids with alcohols and silicones, which are a silicon-oxygen polymeric chain to which are attached hydrocarbon branches composed of either alkyl or phenyl groups and fluorinated or polyfluorinated derivatives of any of the preceding fluids, or combinations thereof.

The lubricating oil typically comprises at least about 50 weight percent, preferably at least about 60 weight percent, and more preferably at least about 70 weight percent of the lubricating composition. To form a grease, the lubricating oil is conveniently thickened to a grease consistency with an oil thickener. Generally two types of thickeners are used—soaps and/or non-soaps.

A soap-base thickening agent as used herein is defined as being one or more of the metal soaps of saponifiable fats, oils or fatty acids which are capable of providing a stable gel structure to lubricating base oils. Typical fatty materials used herein are derived from those having carbon chains from about 10 to about 40 atoms ($C_{10}$ to $C_{40}$), preferably from about 15 to about 30 atoms, in length. Other saponifiable materials used in the manufacture of lubricating greases include distilled rosin oil, naphthenic acids, sulfonic acids, montan wax and wool wax.

The term soap-base includes single base metal soaps, mixed base soaps and complex soaps as follows:

SINGLE BASE METAL SOAPS

Soaps of aluminum, barium, calcium, lead, lithium, lead, magnesium, sodium or strontium including stearates, oleates, palmitates, hydroxy stearates, acetates, sulfonates, azelates, acrylates and benzoates.

MIXED BASE SOAPS

Soaps of two or more metals in mixtures of varying amounts. Typical mixed base soaps include the stearates, oleates, palmitates, hydroxystearates, acetates, acrylates, azelates, benzoates and sulfonates of aluminum-calcium, aluminum-lead, aluminum-lithium, aluminum-sodium, aluminum-zinc, barium-aluminum, barium-calcium, barium-lithium, calcium-magnesium, calcium-sodium, lithium-aluminum, lithium-aluminum-lead, lithium-aluminum-zinc, lithium-calcium, lithium-potassium, lithium-sodium, sodium-barium, sodium-calcium, sodium-lead, sodium-lithium and sodium-zinc.

COMPLEX SOAPS

Soaps having dissimilar acid radicals associated with a single metal ion, sometimes mixed with metallic salts and/or organic polar compounds and metal soaps of polycarboxylic acids. Examples include aluminum benzoate-stearate-hydroxide (aluminum complex), barium acetate-stearate (barium complex), calcium acetate-stearate (calcium complex) and dilithium azelate mixed with lithium borate (lithium complex).

Non-soap thickeners include all those thickeners not prepared by the process of saponification. Such materials include one or more thickeners chosen from silica gel, clays such as bentonite, kaolinite, montmorillonite, monazite and hectorite, polymers, polyurea, carbon black, dyes and pigments. In use, the oil thickener is generally mixed with the lubricating oil in an amount sufficient to impart a grease-like consistency thereto, generally in a concentration between about 0.1 and about 30 weight percent, preferably between about 3 and 20 weight percent.

The extreme pressure/anti-wear, anti-oxidation additives which impart enhanced properties to the lubricating compositions of the present invention comprise one or more adducts formed between a calcium thiocarbonate and calcium oxide or hydroxide. The calcium thiocarbonate salts of this invention have the general formula $Ca_x(C_aS_b)_2$ wherein a, the number of carbon atoms therein, ranges between about 1 and about 4, preferably between about 1 and about 3, and more preferably is 1, b, the number of sulfur atoms therein, ranges between about 3 and about 9, preferably between about 3 and about 6, and more preferably is 3 or 4, and x is the valence of $(C_aS_b)$.

The basic chemistry of the thiocarbonic acids and salts has been studied in some detail for many years, as indicated by O'Donoghue and Kahan, Journal of the Chemical Society, Vol 89(II), pages 1812–1818 (1906); Yeoman, Journal of the Chemical Society, Vol 119, pages 38–54 (1921); Mills and Robinson, Journal of the Chemical Society Vol. 128(II), pages 2236–2332 (1928) and by Stone et al in U.S. Pat. No. 2,893,835, dated July 7, 1959.

According to O'Donoghue and Kahan, "calcium thiocarbonate" is described as a double salt of the calcium cation in combination with both the hydroxide and the trithiocarbonate anions. Since substantially neutral solutions of calcium thiocarbonate can exist, it appears that the term "adduct" may be a better descriptor for the basic calcium "double salt" and this term shall hereinafter be used to describe this material.

In addition to making the free thiocarbonic acid, other compounds prepared by O'Donoghue and Kahan included the sodium, potassium, zinc and lead salts. A common characteristic with all these salts and acids was their relative instability, with the prepared compounds breaking down and releasing carbon disulfide, hydrogen sulfide and/or a metal sulfide, often in a matter of minutes. This breakdown has been attributed to a reaction of the thiocarbonate with oxygen, carbon dioxide and/or, most particularly, water. Methods for protecting various thiocarbonate salts, esters and complexes from such breakdown and decomposition are given in Assignee's copending application Ser. No. 07/290,992, filed Dec. 28, 1988, herein incorporated, by reference, in its entirety.

Although hydrogen sulfide and carbon disulfide would be expected to react to form trithiocarbonic acid according to the reaction:

$$H_2S + CS_2 \rightarrow H_2CS_3 \quad (1)$$

such is not the case. Consequently, other approaches to making derivatives of the thiocarbonic acids must be used.

Solutions of trithiocarbonate salts useful as a basis for preparing the adduct of the present invention can be prepared by reacting a mixture, preferably a stoichiometric mixture, of carbon disulfide and a source of sulfide of the form $M_2S_y$, wherein M is a positive salt-forming moiety and y is the valence of M, said reaction being performed under conditions sufficient to produce a trithiocarbonate salt according to the general reaction:

$$M_2S_y + yCS_2 \rightarrow M_2(CS_3)_y \quad (2)$$

This reaction may be carried out at any temperature from 0° C. to the boiling point of carbon disulfide, and preferably from about 15° C. to about 35° C. The reaction is preferably carried out under an inert or reducing gas atmosphere to avoid oxidation of any of the sulfur compounds to sulfur oxide moieties such as thiosulfate.

While cationic salt-forming moieties for M can be ammonium, quaternary ammonium, quaternary phosphonium, quaternary arsonium, metals and metal complexes formed with commonly known ligands such as ammonia, ethylenediamine, diethylenetriamine, propylenediamine and pyridine, it is preferred that these moieties be ammonium or an alkali metal, preferably ammonium, sodium or potassium. The salt can be converted into the adduct by adding a calcium salt which is also soluble in the reaction medium, such as the acetate, nitrate or chloride, while raising the pH with a solution of ammonium, sodium or potassium hydroxide.

The presence of significant amounts of water in the reaction vessel has been reported to cause the formation of pasty, crusty, oil-like salt deposits therein, which are removable only with the greatest difficulty. Moreover, even for thiocarbonate species which are nominally insoluble in water, long-term exposure to water will often cause some degree of degradation. Consequently, the basic reaction preferably takes place in a water-free liquid medium, which, while being a solvent for the source of sulfide, does not dissolve, to any great extent, the final thiocarbonate salt formed by this reaction, thus allowing it to precipitate out for subsequent recovery.

While any "water-free" solvent for the source of sulfide may be used, the preferred solvents in which to perform this reaction are the lower molecular weight, saturated absolute alcohols such as methanol, ethanol, propanol, isopropanol, n-butanol, isobutanol and secondary butanol. Such alcohols offer the advantages of (1) being commercially available in a water-free, absolute condition at low cost, (2) being miscible with carbon disulfide, and (3) being relatively good solvents for the metal sulfides and acetates used. The particular alcohol used depends on the particular end-product desired. For example, where the end-product is an alkaline earth metal thiocarbonate, particularly a calcium thiocarbonate, the relatively high solubilities of the precursor potassium salt and calcium chloride in methanol and, particularly, ethanol dictates that one of these alcohols be used, in contrast to the higher molecular weight alcohols such as isopropanol or n-butanol, in which they are much less soluble.

Where an alcohol is used as the water-free solvent, one convenient way of forming the source of sulfide is the reaction of hydrogen sulfide with a metal alkoxide of the form $M(OA)_y$, wherein A is an alkyl radical and y is the valence of M. This alkoxide is generated in-situ either by dissolving an alkali metal, preferably sodium or potassium, and most preferably, potassium, or a reactive hydroxide, preferably an alkali metal hydroxide, most preferably sodium or potassium and, very most preferably, potassium hydroxide, in the alcohol according to the reactions:

$$2K+2AOH \rightarrow 2KOA+H_2 \quad (3)$$

or, preferably, by:

$$KOH+AOH \rightarrow KOA+H_2O \quad (4)$$

Because of the aforementioned sensitivity of the thiocarbonate anion to the presence of water, it is highly preferable that the water generated in reaction (4) be removed prior to any further processing. One approach for so doing is to heat the solution to a temperature high enough for an alcohol-water azeotrope to form and boil off. Another approach is to pass the solution through an adsorbent, such as a molecular sieve, which is useful for separating out the water.

After the water is removed, passing hydrogen sulfide through the remaining solution will convert the alkoxide to said source of sulfide, after which the addition of carbon disulfide, as shown in equation (2) above, will complete the reaction.

Tetrathiocarbonate salts are prepared in a similar manner, with the general reaction defined in equation (2) above being:

$$yS+M_2S_y+yCS_2 \rightarrow M_2(CS_4)_y \quad (5)$$

and are converted to a calcium adduct by reacting these with calcium chloride while raising the pH to precipitate the thiocarbonate/hydroxide adduct.

Another method for making alkaline earth and heavy metal salts is by reacting a water soluble salt, such as the acetate, nitrate or chloride, with a stable aqueous solution of slightly basic ammonium thiocarbonate, such as that prepared by the procedure of Example 1 in U.S. Pat. No. 4,726,144, the teachings of which are incorporated herein in their entirety, by reference, to form an insoluble salt product. To form the calcium adduct of the present invention, the soluble "salt" is preferably calcium chloride, with an additional amount of a soluble base such as ammonia, potassium hydroxide or sodium hydroxide being used to raise the pH the level necessary to precipitate the calcium thiocarbonate/calcium hydroxide adduct.

Still a third method for preparing the adduct of the present invention rests upon the fact that alkaline earth metal thiocarbonates are somewhat more stable in aqueous solution than the analogous ammonium and alkali metal thiocarbonates. Thus, the adduct may be prepared by reacting calcium sulfide (where a trithiocarbonate is being formed) or a mixture of calcium sulfide and sulfur (where a tetrathiocarbonate is being formed) directly with carbon disulfide, at conditions sufficient to produce the calcium tri- or tetrathiocarbonate and then adding a soluble base to precipitate the calcium adduct. Preferably the above reaction takes place in aqueous solution with any sulfur required merely being dispersed therein. Calcium sulfide may be developed in-situ by contacting either an aqueous suspension of calcium hydroxide or an aqueous solution containing a soluble calcium salt precursor such as the nitrate, acetate or, preferably, the chloride with hydrogen sulfide, either prior to or simultaneously with the addition of carbon disulfide.

The reactants are preferably provided in essentially stoichiometric amounts corresponding to one mole of calcium sulfide to one mole of carbon disulfide for the trithiocarbonate and a mole of sulfur, in addition, for the tetrathiocarbonate. The reaction is preferably carried out under an inert gas atmosphere to avoid oxidation of any of the sulfur compounds to sulfur oxide moieties such as thiosulfate. As with the general procedure disclosed above, the reaction may be carried out at a temperature of from 0° C. to the boiling point of carbon disulfide, and preferably from about 15° C. to about 35° C. for convenience.

The concentration of dissolved calcium thiocarbonate salt in the resulting solution will normally range from about 0.01 to about 55 weight percent for the trithiocarbonate and to about 45 weight percent for the tetrathiocarbonate. The adduct of the present invention is formed by adding a surplus of a soluble calcium salt in conjunction with a pH raising amount of an aqueous solution of ammonia or an alkali metal base. The adduct will then form as a reddish-yellow solid which can be recovered from the water solute simply by filtering or centrifuging it. The adduct thus formed is stable in the presence of water, oxygen and carbon dioxide for relatively long periods of time.

The calcium thiocarbonate/hydroxide adduct of the present invention comprises a minor part (i.e., less than 50 weight percent) of the lubricating composition, typically from about 0.1 to about 20 weight percent, preferably from about 0.5 to about 10 weight percent. If desired, the adduct described herein may be employed in conjunction with other additives commonly employed in lubricants. Thus, there may be added to the lubricants of this invention rust inhibitors, corrosion and other oxidation inhibitors and other anti-wear/extreme pressure agents. The only requirement to adding these additional additives herein is that they be compatible with the thiocarbonate adduct constituent of the lubricating composition.

The calcium adduct described herein enhances one or more properties of lubricating oils and greases. For example, with the combination of the anti-oxidation properties of the thiocarbonate moiety and the basic properties of the hydroxide moiety, it can lower the amount of oil oxidation which occurs in service and/or lower the amount of oxide and hydroxide bases needed to combat acids formed in service by such oxidation. When used in greases, the adduct can be reacted with an acid to form a calcium soap which can be used as part, or all, of the thickener used therein.

The adduct also improves the anti-wear/extreme pressure properties of lubricating oils and greases and to protect mechanical components such as gears, bearings, threaded bolts and couplings, and the like, when subjected to sliding or rolling motion under very heavy loads from experiencing excessive wear. Such enhancement can be shown when lubricants with and without the additives of the present invention are compared using, for example, conventional rotating 4-ball tests either at a constant load, as defined in ASTM D-2296 (for anti-wear evaluation) or under a steadily increasing load, as defined in ASTM D-2596 (for extreme pressure evaluation).

The adduct also enhances the stability of lubricants when they are exposed to conditions which result in severe oxidation and degradation of an unprotected lubricant. Such enhancement can be shown by a reduction in the oxygen pressure loss observed when lubricants, with and without the additives of the present invention, are compared under the test conditions of ASTM D-942.

In addition to being a grease component, the thiocarbonate adduct described herein may be dissolved or suspended in a lubricating oil. When a suspension is formed, conventional suspending agents, emulsifiers or suspension stabilizers are employed with the thiocarbonate salt to ensure that a homogeneous mixture of lubricating oil and adduct results. For this purpose up to about 20 weight percent, preferably from about 0.5 to about 10 weight percent of such materials may be used.

The thiocarbonate adduct described herein may also be incorporated into lubricating pastes. Lubricating pastes, commonly referred to as "pipe dope," are used as thread lubricants, thread sealing and lubricating compounds, or tool joint compounds. Thread lubricants prevent structures comprising threaded metal parts such as pipes, couplings, nuts or bolts from galling, scuffing, and/or seizing during assembly and disassembly and also fill in any irregularities in the threads so that the joint will better withstand high pressures. These lubricants generally contain an EP agent to prevent such damage.

The invention will be further described with reference to the following examples which are provided to illustrate and not limit the present invention.

EXAMPLE 1

In 585 grams of distilled water, 115.8 grams (2.1 moles) of calcium oxide was slurried, after which 71.6 grams (2.1 moles) of hydrogen sulfide was, with good mixing, bubbled in. The reaction produced a dark green aqueous slurry into which 67.4 grams (2.1 moles) of powdered sulfur was added, with stirring, which converted the slurry to a dark yellow color. When 180.6 grams (2.1 moles) of carbon disulfide was added, the slurry then dissolved to form a deep yellow colored solution of calcium tetrathiocarbonate. The adduct of the present invention was produced when separate solutions of 1M calcium chloride and 2M sodium hydroxide were simultaneously added, over a period of about 1 hour. This resulted in the formation of a dark yellow precipitate which was separated from the water, washed three times with a 50/50 mixture of absolute alcohol and carbon disulfide, and air dried.

EXAMPLE 2

To 1250 ml of a stirred aqueous solution containing 0.27 mole of sodium tetrathiocarbonate were simultaneously added, from separate addition funnels over a period of about 1 hour at room temperature, 800 ml of an aqueous solution containing 1 mole of sodium hydroxide and 2000 ml of an aqueous solution containing 0.68 mole of calcium chloride. An orange-yellow solid similar in appearance to the product of Example 1 precipitated as the three solutions were mixed. This was separated by filtration, washed twice with ethanol and then twice with ethyl ether, and vacuum dried. The yield was 53 grams.

EXAMPLE 3

The adduct of Example 1 was tested for extreme pressure (EP) properties in a grease composition comprising 7 weight percent lithium 12-hydroxy stearate and 93 weight percent SAE 40 oil (70 SUS at 210° F.) by determining the four-ball EP weld load for the composition.

The weld load, in KG force, is determined by the ASTM D-2596 Four-Ball EP test in which a steel ball, under a constant force or load, is rotated at a speed of 1770 RPM against three other balls held in a stationary position in the form of a cradle. The temperature is maintained at 80° F. and the rotating ball is subjected to successively higher loads for 10 seconds each until the four balls weld together. The results are summarized in Table 1 below.

TABLE 1

| | Composition, Wt. % | |
|---|---|---|
| Lithium grease | 100 | 96 |
| Calcium thiocarbonate adduct | 0 | 4 |
| Four-Ball EP weld load ((KG force)) | 126–160 | 400 |

From this, it can be seen that by adding as little as about 4 weight percent of the calcium tetrathiocarbonate/calcium hydroxide adduct of the present invention, the anti-wear properties of a commercial lithium grease are more than doubled as compared to the same grease with no adduct incorporated therein.

Obviously many modifications and variations of this invention, as hereinabove set forth, may be made without departing from the spirit and scope thereof, and therefore only such limitations should be imposed as are indicated in the following claims. All embodiments which come within the scope and equivalency of the claims are, therefore, intended to be embraced therein.

We claim:

1. A lubricating composition comprising a major amount of a lubricant and a minor amount of an adduct of a calcium thiocarbonate and calcium hydroxide.

2. The lubricating composition of claim 1 comprising the calcium thiocarbonate constituent of said adduct has the general formula $Ca_x(C_aS_b)_2$ wherein a, the number of carbon atoms therein ranges between 1 and about 4, b, the number of sulfur atoms therein ranges between 3 and about 9, and X is the valence of $(C_aS_b)$.

3. The lubricating composition of claim 2 wherein a ranges between 1 and about 3 and b ranges between 3 and about 6.

4. The lubricating composition of claim 1 wherein said lubricant comprises an oil of lubricating viscosity.

5. The lubricating composition of claim 1 wherein said lubricant is a grease comprised of an oil and one or more oil thickeners.

6. The lubricating composition of claim 5 wherein said oil thickener is selected from the group consisting of simple metal soaps, mixed base soaps, complex soaps, silica gel, clay, polymers, polyurea, carbon black, dyes, and mixtures thereof.

7. A lubricating composition comprising a major portion of a lubricant and a minor amount of an adduct of a calcium tetrathiocarbonate of the form $CaCS_4$ and calcium hydroxide.

8. A lubricating composition comprising a major portion of a lubricant and a minor amount of an adduct of a calcium trithiocarbonate of the form $CaCS_3$ and calcium hydroxide.

9. The lubricating composition of claims 7 or 8 wherein said lubricant comprises an oil of lubricating viscosity.

10. The lubricating composition of claims 7 or 8 wherein said lubricant is a grease comprised of an oil and between about 0.1 and about 30 weight percent of one or more oil thickeners.

11. The lubricating composition of claim 10 wherein said thickener is selected from the group consisting of simple metal soaps, mixed base soaps, complex soaps, silica gel, clay, polymers, polyurea, carbon black, dyes, and mixtures thereof.

12. A lubricating composition as defined in claims 7 or 8 comprising a mixture of:

at least 50 percent by weight of an oil of lubricating viscosity;

up to about 30 weight percent of one or more oil thickeners; and from about 0.1 to about 20 weight percent of said adduct.

13. The lubricating composition of claim 1 wherein said composition comprises an oil of lubricating viscosity and between about 0.5 and about 10 weight percent of an adduct of a calcium thiocarbonate and calcium hydroxide.

14. The lubricating composition of claim 12 wherein said oil thickener is present in an amount between about 3 and about 20 weight percent.

15. The lubricating composition of claim 14 wherein said oil thickener is selected from the group consisting of simple metal soaps, mixed base soaps, complex soaps, silica gel, clay, polymers, polyurea, carbon black, dyes, and mixtures thereof.

16. The lubricating composition of claim 14 wherein said thickener comprises a lithium soap, a lithium complex soap, or a mixture thereof.

17. A method of enhancing the lubrication of metal components subjected to sliding or rolling motion comprising lubricating said components with the lubricating composition of claim 1.

18. A method of enhancing the lubrication of metal components subjected to sliding or rolling motion comprising lubricating said components with the lubricating composition of claims 7 or 8.

19. The method of claim 18 wherein said lubricating composition comprises an oil of lubricating viscosity.

20. The method of claim 19 wherein said oil further comprises an oil thickener selected from the group consisting of simple metal soaps, mixed base soaps, complex soaps, silica gel, clay, polymers, polyurea, carbon black, dyes, and mixtures thereof.

21. A lubricating composition comprising a major amount of lubricant and a minor amount of an adduct comprising the reaction product of a water soluble calcium salt, a source of sulfide of the form $M_2S_y$ wherein M is hydrogen or a positive salt forming moiety and y is the valence of M, and carbon disulfide, said reaction product forming as a result of the reaction of about equal molar amounts of carbon disulfide, sulfide from said source of sulfide, and said water soluble calcium salt, said reaction product being reacted in turn with a pH raising amount of a soluble base to precipitate said adduct.

22. A lubricating composition comprising a major amount of lubricant and a minor amount of an adduct comprising the reaction product of a water soluble calcium salt, a source of sulfide of the form $M_2S_y$ wherein M is hydrogen or a positive salt forming moiety and y is the valence of M, sulfur and carbon disulfide, said reaction product forming as a result of the reaction of about equal molar amounts of sulfur, carbon disulfide, sulfide from said source of sulfide, and said water soluble calcium salt, said reaction product being reacted in turn with a pH raising amount of a soluble base to precipitate said adduct.

23. The lubricating composition of claims 21 or 22 wherein said source of sulfide is hydrogen sulfide.

24. The lubricating composition of claim 23 wherein said soluble calcium salt is selected from the group consisting of the calcium nitrate, calcium chloride and calcium acetate.

25. The lubricating composition of claim 23 wherein said calcium salt is calcium chloride.

26. The lubricating composition of claims 21 or 22 wherein said lubricant comprises an oil of lubricating viscosity.

27. The lubricating composition of claims 21 or 22 wherein said lubricant is a grease comprised of an oil and an oil thickener selected from the group consisting of simple metal soaps, mixed base soaps, complex soaps, silica gel, clay, polymers, polyurea, carbon black, dyes, and mixtures thereof.

28. The lubricating composition of claims 21 or 22 wherein said minor amount is between about 0.1 and about 20 weight percent.

29. A method of enhancing the lubrication of metal components subjected to sliding or rolling motion comprising lubricating said components with the lubricating composition of claims 21 or 22.

30. The method of claim 29 wherein said lubricating composition comprises an oil of lubricating viscosity.

31. The method of claim 29 wherein said lubricant is a grease comprised of an oil of lubricating viscosity and one or more oil thickeners.

32. The method of claim 31 wherein said oil thickener is selected from the group consisting of simple metal soaps, mixed base soaps, complex soaps, silica gel, clay, polymers, polyurea, carbon black, dyes, and mixtures thereof.

33. The method of claim 29 wherein said lubricating composition comprises a metal-tetrathiocarbonate complex in a concentration between about 0.1 and about 20 weight percent.

34. A lubricating composition comprising a major amount of a lubricant and a minor amount of an adduct comprising the reaction product of a mixture of a source of sulfide of the form $M_2S_y$, wherein M is a positive salt forming moiety and Y is the valence of M, and carbon disulfide, said reaction being performed under conditions sufficient to produce a trithiocarbonate of the form $M_2(CS_3)_y$, with said reaction product being reacted in the presence of a water soluble calcium salt and a pH raising amount of a soluble base to precipitate said adduct.

35. A lubricating composition comprising a major amount of a lubricant and a minor amount of an adduct comprising the reaction product of a mixture of a source of sulfide of the form $M_2S_Y$, wherein M is a positive salt forming moiety and Y is the valence of M, and carbon disulfide, said reaction being performed under conditions sufficient to produce a tetrathiocarbonate of the form $M_2(CS_4)_y$, with said reaction product being reacted in the presence of a water soluble calcium salt and a pH raising amount of a soluble base to precipitate said adduct.

36. A lubricating composition comprising a major amount of a lubricant and a minor amount of an adduct comprising the reaction product of a water soluble calcium salt, carbon disulfide and one or more sources of sulfur selected from the group consisting of elemental sulfur and sulfides of the form $M_2S_Y$, wherein M is a positive salt forming moiety and Y is the valence of M, and carbon disulfide, said reaction product forming as the result of the reaction of said calcium salt, source of sulfur, and carbon disulfide, with the resultant composition has the general formula $Ca_x(C_aS_b)_2$ wherein a, the number of carbon atoms therein ranges between 1 and about 4, b, the number of sulfur atoms therein ranges between 3 and about 9, and X is the valence of $(C_aS_b)$, said reaction product, in turn, being reacted with a pH raising amount of a water soluble base to precipitate said adduct.

37. The lubricating composition of claim 36 wherein said lubricant comprises an oil of lubricating viscosity.

38. The lubricating composition of claim 36 wherein said lubricant is a grease comprised of an oil and one or more oil thickeners.

39. The lubricating composition of claim 36 wherein said oil thickener is selected from the group consisting of simple metal soaps, mixed base soaps, complex soaps, silica gel, clay, polymers, polyurea, carbon black, dyes, and mixtures thereof.

40. The lubricating composition of claim 36 wherein said composition comprises an oil of lubricating viscosity and between about 0.05 and about 10 weight percent of said calcium thiocarbonate adduct.

41. A method of enhancing the lubrication of metal components subjected to sliding or rolling motion comprising lubricating said components with the lubricating composition of claim 36.

* * * * *

UNITED STATES PATENT AND TRADEMARK OFFICE

CERTIFICATE OF CORRECTION

PATENT NO. : 4,909,951

DATED : March 20, 1990

INVENTOR(S) : Leah T. Mendelson and Richard L. Pilling

It is certified that error appears in the above-identified patent and that said Letters Patent is hereby corrected as shown below:

Claim 24, column 10, line 47, delete "the";

Claim 40, column 12, line 30, "0.05" should be -- 0.5 --.

Signed and Sealed this

Fifth Day of March, 1991

*Attest:*

HARRY F. MANBECK, JR.

*Attesting Officer*

*Commissioner of Patents and Trademarks*